US010690086B2

(12) United States Patent
Keating et al.

(10) Patent No.: US 10,690,086 B2
(45) Date of Patent: Jun. 23, 2020

(54) DIRECT FUEL INJECTION, TWO-VALVE PER CYLINDER PUSHROD VALVETRAIN COMBUSTION SYSTEM FOR AN INTERNAL COMBUSTION ENGINE

(71) Applicant: GM GLOBAL TECHNOLOGY OPERATIONS LLC, Detroit, MI (US)

(72) Inventors: Edward J. Keating, Ortonville, MI (US); Kenneth M. Eastman, Troy, MI (US); Erwan R. Gautier, Plymouth, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/103,971

(22) Filed: Aug. 16, 2018

(65) Prior Publication Data

US 2020/0056562 A1 Feb. 20, 2020

(51) Int. Cl.

| | |
|---|---|
| ***F01L 13/00*** | (2006.01) |
| ***F02F 1/24*** | (2006.01) |
| ***F01L 1/14*** | (2006.01) |
| ***F02M 61/14*** | (2006.01) |
| ***F02F 1/42*** | (2006.01) |
| ***F02F 7/00*** | (2006.01) |

(52) U.S. Cl.

CPC ..... *F02F 1/242* (2013.01); *F01L 1/146* (2013.01); *F02F 1/4285* (2013.01); *F02F 7/006* (2013.01); *F02M 61/14* (2013.01); *F02F 2001/245* (2013.01)

(58) Field of Classification Search

CPC ..... F02F 1/242; F02F 1/4285; F02F 7/006; F01L 1/146; F01L 1/02; F01L 1/04; F01L 1/14; F01L 1/18; F01L 13/0005; F01L 13/0042; F02M 61/14

USPC ..... 123/90.18, 188.2, 188.16

See application file for complete search history.

(56) References Cited

U.S. PATENT DOCUMENTS

| | | | | |
|---|---|---|---|---|
| 5,526,797 A * | 6/1996 | Stokes | F02D 15/04 | 123/525 |
| 6,505,592 B1 * | 1/2003 | Hayman | F01L 1/00 | 123/90.27 |
| 2002/0195079 A1 * | 12/2002 | Kubo | F02B 17/005 | 123/295 |

* cited by examiner

*Primary Examiner* — Hai H Huynh
*Assistant Examiner* — Gonzalo Laguarda
(74) *Attorney, Agent, or Firm* — Reising Ethington P.C.; James Howard

(57) ABSTRACT

A pushrod valvetrain combustion system assembly for an internal combustion engine includes a two-valve pushrod assembly and a cylinder top that forms a portion of a cylinder head. The cylinder top has a single intake port, a single exhaust port, a spark plug bore, and a fuel injector bore. The pushrod assembly includes an intake valve positioned in the intake port and an exhaust valve positioned in the exhaust port. The intake port and exhaust port are positioned adjacent each other and are positioned along an axis that intersects a center point of each of the ports. The intersecting axis is rotated relative to a centerline of the crankshaft of the engine, providing space for the spark plug bore and fuel injector bore to both be located in the cylinder top on a same side of the intersecting axis.

20 Claims, 7 Drawing Sheets

DIRECT FUEL INJECTION, TWO-VALVE PER CYLINDER PUSHROD VALVETRAIN COMBUSTION SYSTEM FOR AN INTERNAL COMBUSTION ENGINE

INTRODUCTION

The present invention relates to direct fuel injection, two-valve per cylinder pushrod valvetrain combustion systems used in internal combustion engines.

Typical internal combustion engines of the above-noted type have limited overhead room for the spark plug and fuel injector due to the space taken up by the pushrod and rocker arms. Consequently, in conventional designs the spark plug and fuel injector are positioned on opposite sides of the central plane of the cylinder, and at significant angles relative to the central axis of the cylinder. An example of this is shown in FIG. 1 showing a cylinder top in which intake and exhaust valves are centered on a vertical (x-z) plane that intersects with the crankshaft axis (not shown), thereby forming a conventional valve layout that is in-line with the crankshaft. A spark plug and fuel injector are mounted on opposite sides of that vertical plane at large angles relative to the plane. This arrangement can limit the ability to achieve optimal combustion dynamics, as it spaces the spark plug farther away from the injector than may be desired and requires these components to be oriented more horizontally within the combustion chamber than may be desired.

SUMMARY

According to one aspect of the invention, there is provided a pushrod valvetrain combustion system assembly for an internal combustion engine. The combustion system assembly includes a two-valve pushrod assembly and a cylinder top that forms a portion of a cylinder head. The cylinder top is configured to close the top of an engine cylinder in an engine block to thereby at least partially define a combustion chamber between the cylinder top and engine cylinder. The cylinder top includes a single intake port, a single exhaust port, a spark plug bore, and a fuel injector bore. The two-valve pushrod assembly includes:

- first and second pushrods each having a lifter configured to be driven by cams on a camshaft of the internal combustion engine;
- first and second rocker arms that are mounted above the cylinder top and that are driven by the first and second pushrods, respectively;
- an intake valve positioned in the intake port and having a valve stem driven by the first rocker arm; and
- an exhaust valve positioned in the exhaust port and having a valve stem driven by the second rocker arm.

The intake port and exhaust port are positioned adjacent each other and are positioned along an axis that intersects a center point of each of the ports. The spark plug bore and fuel injector bore are both located in the cylinder top on a same side of the axis intersecting the center points of the intake and exhaust ports.

According to various embodiments, the combustion system may further include any one of the following features or any technically-feasible combination of some or all of these features:

- the cylinder top has a circular periphery lying within a plane oriented perpendicular to a reference axis, and the fuel injector bore has a central bore axis that is at an angle of between 10 and 20 degrees, inclusive, relative to the reference axis.

- the spark plug bore has a central bore axis that is at an angle of between 15 and 25 degrees, inclusive, relative to the central bore axis of the fuel injector bore.
- the spark plug bore and fuel injector bore are located first and second distances, respectively, from a center point of the cylinder top, and wherein the first distance is less than the second distance and, optionally, the spark plug bore and fuel injector bore each have a radius, wherein the difference between the first and second distances is greater than the sum of the radii of the spark plug and fuel injector bores.
- the pushrod valvetrain combustion system assembly includes a plurality of the cylinder tops and a corresponding plurality of the pushrod assemblies, wherein the plurality of cylinder tops and pushrod assemblies are associated with a corresponding plurality of engine cylinders in the engine block, and wherein:
  - each of the cylinder tops has a circular periphery oriented perpendicular to a common plane that extends through each cylinder top and that includes a central axis of each of the engine cylinders when the cylinder head is mounted to the engine block; and
  - the axis intersecting the center points of the intake and exhaust ports of each cylinder top is at a non-zero angle relative to the common plane; optionally, this non-zero angle is between 25 and 45 degrees, inclusive.
- when the plurality of cylinder tops and pushrod assemblies are used, the combustion system may further comprise an intake manifold and an exhaust manifold, wherein the intake manifold extends from the intake ports of the cylinder tops in a first direction away from a first side of the common plane and the exhaust manifold extends from the exhaust ports of the cylinder tops in a second direction away from a second side of the common plane, and wherein the fuel injector bore is located on the second side of the common plane. The pushrods may be located on the first side of the common plane and the spark plug bore located on the second side of the common plane.

According to another aspect of the invention, there is provided a direct fuel injection, two-valve (per cylinder) pushrod valvetrain internal combustion engine that includes an engine block having a plurality of cylinders, a cylinder head having a plurality of cylinder tops each aligned with a different one of the engine cylinders, a pushrod valvetrain system, a plurality of spark plugs, a plurality of fuel injectors, a crankshaft mounted within the engine block and having a crankshaft axis about which the crankshaft rotates, a plurality of pistons each positioned in a different one of the engine cylinders and connected to the crankshaft by a piston rod. Each engine cylinder and associated cylinder top together at least partially define a combustion chamber of the internal combustion engine. Each of the cylinder tops includes a single intake port, a single exhaust port, a spark plug bore, and a fuel injector bore. Each of the spark plugs has a central axis and is mounted within a different one of the spark plug bores so as to provide spark energy within its associated combustion chamber when in use. Each of the fuel injectors has a central axis and is mounted within a different one of the fuel injector bores so as to provide a spray of fuel within its associated combustion chamber when in use. The pushrod valvetrain system includes a camshaft and a plurality of two-valve pushrod assemblies, each of which are positioned at least partially within the cylinder head adjacent a different one of the combustion chambers. The camshaft is mounted beside the engine cylinders. Each of the two-valve pushrod assemblies includes:

- first and second pushrods each having a lifter configured to be driven by cams on the camshaft;
- first and second rocker arms that are mounted above the cylinder top and that are driven by the first and second pushrods, respectively;
- an intake valve positioned in the intake port and having a valve stem driven by the first rocker arm; and
- an exhaust valve positioned in the exhaust port and having a valve stem driven by the second rocker arm.

The intake port and exhaust port of each cylinder top are positioned adjacent each other and are positioned along an axis that intersects a center point of each of the ports. The spark plug bore and fuel injector bore of each cylinder top are both located in the cylinder top on a same side of the axis intersecting the center points of the intake and exhaust ports.

According to various embodiments, the internal combustion engine of the preceding paragraph may further include any one of the following features or any technically-feasible combination of some or all of these features:

- each cylinder top has a circular periphery lying within a plane oriented perpendicular to a reference axis, and the fuel injector central axis is at an angle of between 10 and 20 degrees, inclusive, relative to the reference axis.
- the spark plug central axis is at an angle of between 15 and 25 degrees, inclusive, relative to the fuel injector central axis.
- the spark plug bore and fuel injector bore are located first and second distances, respectively, from a center point of the cylinder top, and wherein the first distance is less than the second distance and, optionally, the spark plug bore and fuel injector bore each have a radius, wherein the difference between the first and second distances is greater than the sum of the radii of the spark plug and fuel injector bores
- each of the engine cylinders has a central axis, with all of the central axes of the engine cylinders lying within a common plane, the crankshaft axis is parallel to or lies within the common plane, and the axis intersecting the center points of the intake and exhaust ports of each cylinder top is at a non-zero angle relative to the common plane; optionally, this non-zero angle is between 25 and 45 degrees, inclusive.
- the engine further includes an intake manifold and an exhaust manifold, wherein the intake manifold extends from the intake ports of the cylinder tops in a first direction away from a first side of a common plane that includes a central axis of each of the cylinders, and the exhaust manifold extends from the exhaust ports of the cylinder tops in a second direction away from a second side of the common plane, and wherein the fuel injector is located on the second side of the common plane. The pushrods may be located on the first side of the common plane and the spark plug bore located on the second side of the common plane.

BRIEF DESCRIPTION OF THE DRAWINGS

One or more embodiments of the invention will hereinafter be described in conjunction with the appended drawings, wherein like designations denote like elements, and wherein.

DETAILED DESCRIPTION

Described below and shown in the accompanying drawings is an embodiment of a direct fuel injection, two-valve per cylinder pushrod valvetrain internal combustion engine having a unique cylinder head design that provides near vertical orientation of the spark plug and fuel injector at a more central location of the cylinder on a single (exhaust) side of the valves. This configuration enables new flexibility in combustion system design, potentially providing for improved fuel economy and drive quality due to enhanced air/fuel mixing that results from the more vertical orientation of the injector and/or spark plug, and from the close positioning of the spark plug to the fuel injector nozzle. As will be appreciated by those skilled in the art, these characteristics of the disclosed design can enable late fuel injection during the combustion cycle, thereby allowing for increased compression ratio due to faster combustion speed, as well as improved knock characteristics and combustion stability via enhanced turbulence created by the late fuel injection.

Figure 2:
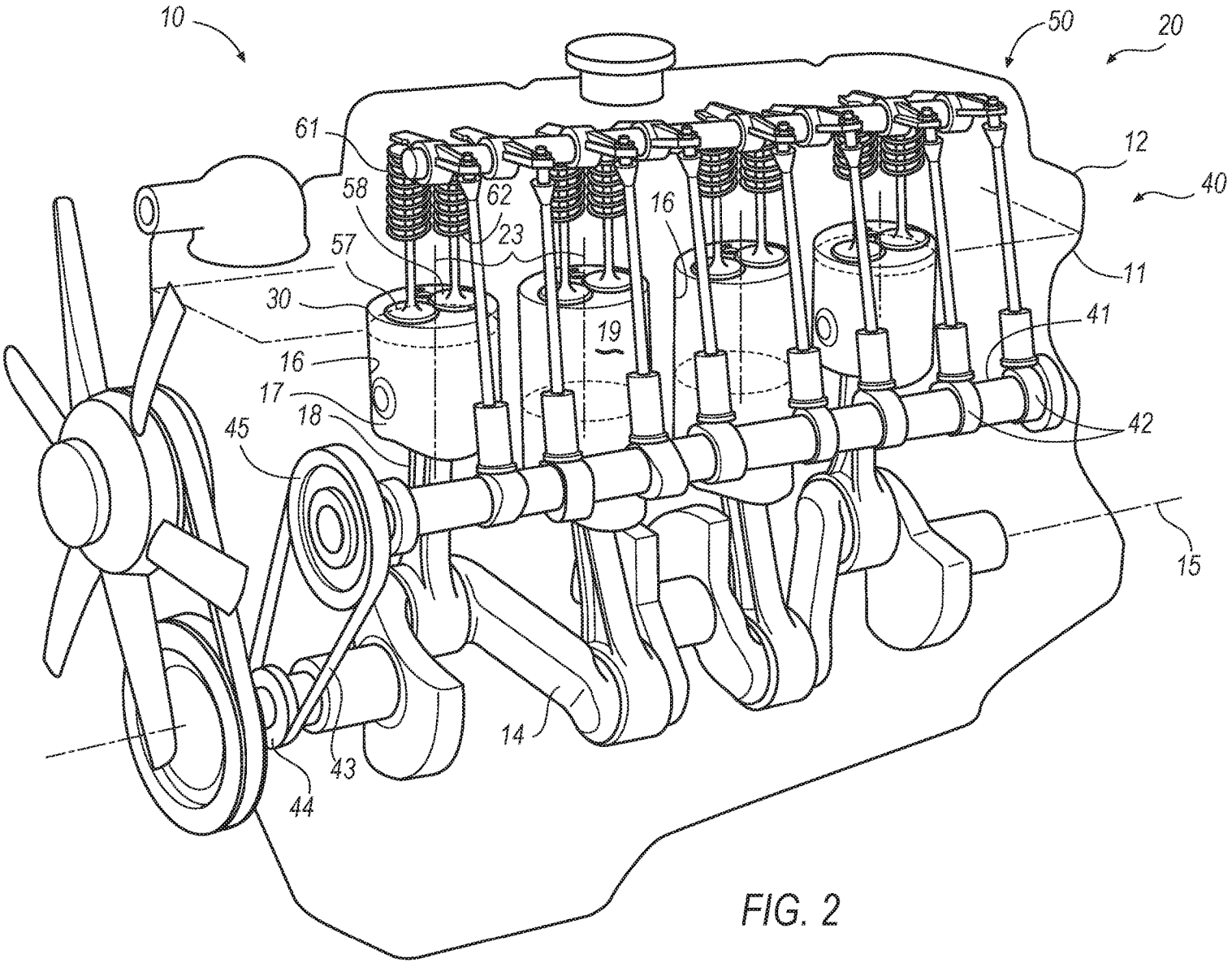
FIG. 2 is a perspective view of a direct fuel injection, two-valve per cylinder pushrod valvetrain internal combustion engine having an in-line four cylinder configuration and being constructed in accordance with an embodiment of the invention.

Referring to FIG. 2, there is shown a direct fuel injection, two-valve (per cylinder) pushrod valvetrain internal combustion engine 10 having an engine block 11 and cylinder head 12 that mates with the engine block. The engine 10 is depicted as an in-line 4-cylinder engine, although more or less cylinders and other cylinder topologies may be used. The engine block 11 houses a crankshaft 14 that is mounted in the engine block for rotation about a crankshaft axis 15. The engine block 11 has four cylinders 16 each having a piston 17 connected to the crankshaft via a piston rod 18. For each cylinder 16 there is a spark plug 70 and fuel injector 80 (see FIGS. 3-7) that enables combustive power to be generated within the cylinder 16.

The engine 10 further includes a pushrod valvetrain combustion system assembly 20 that, for each of the cylinders 16, includes a cylinder top 30 which forms a portion of the cylinder head 12; that is, each cylinder top 30 is formed as a casted, machined and/or other integral or unitary part of the cylinder head 12. Each cylinder top 30 is aligned with a different one of the cylinders 16 to at least partially define a combustion chamber 19 between the cylinder 16 and cylinder top 30. The cylinder tops include a unique configuration of valves and other combustion system components that will be described in greater detail below. Apart from the cylinder tops 30, combustion system assembly 20 further includes a pushrod valvetrain system 40 that includes a camshaft 41 and a separate two-valve pushrod assembly 50 for each of the cylinders 16.

Camshaft 41 is mounted within the engine block beside the cylinders 16 and, as shown, is mounted for rotation along a camshaft axis that is parallel to the crankshaft axis 15. The camshaft 41 includes cams (or cam lobes) 42 with a profile and orientation on the camshaft selected to effect the opening and closing of valves on the cylinder tops 30, as is known. The camshaft 41 may be driven via a timing chain 43 running from a sprocket 44 on the crankshaft 14 to a sprocket 45 on the camshaft 41.

Figure 3:
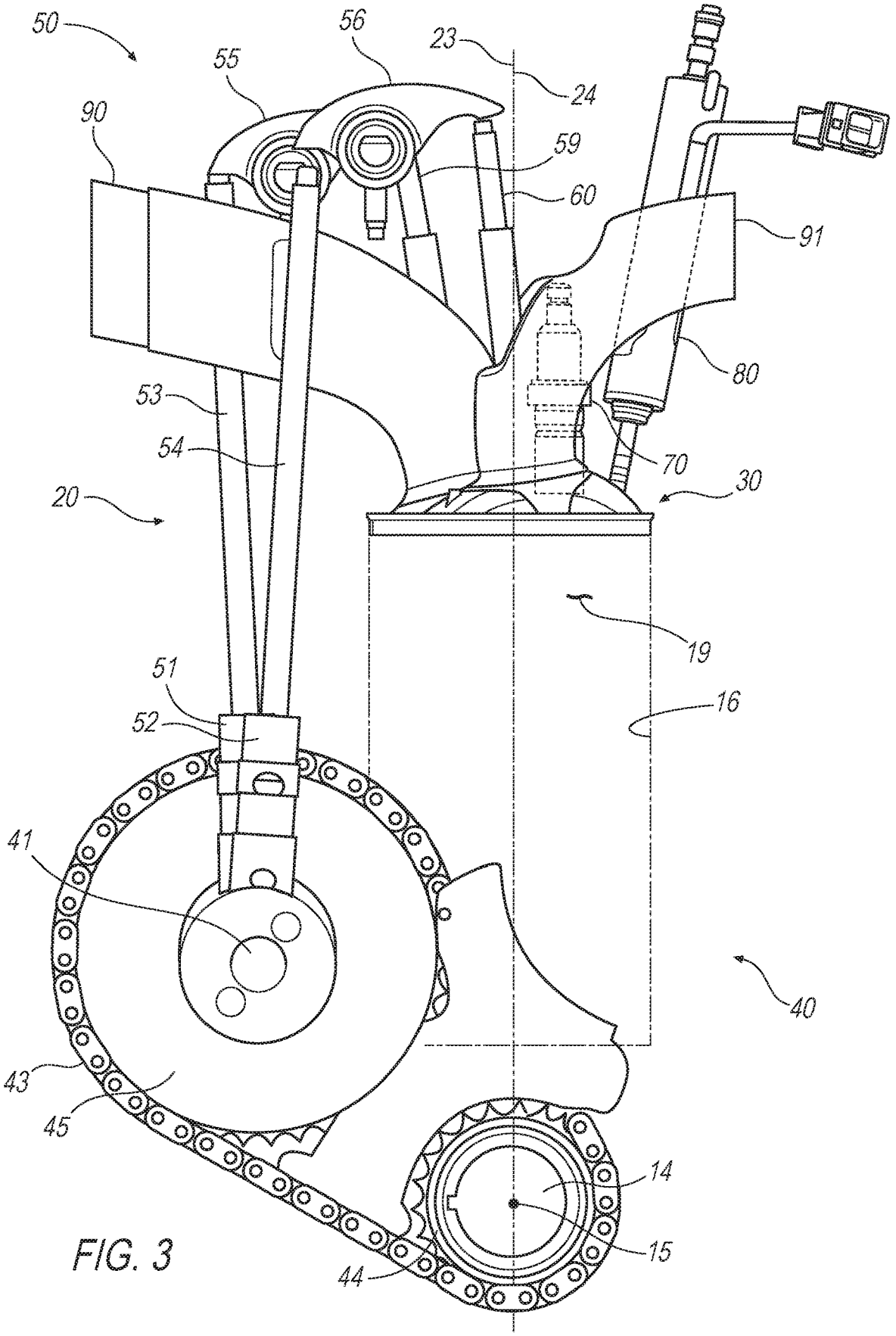
FIG. 3 is an end view of a two-valve pushrod valvetrain combustion system assembly such as may be used for each of the cylinders of the engine of FIG. 2.

Referring now also to FIG. 3, one of the two-valve pushrod assemblies 50 will be described, it being understood that the other pushrod assemblies 50 can be similarly or identically constructed. In general, each pushrod assembly 50 includes a pair of lifters 51, 52, a pair of pushrods 53, 54, a pair of rocker arms 55, 56, a pair of valves 57, 58 having respective valve stems 59, 60, and a pair of valve springs 61, 62 (shown in FIG. 2). The general operation of the pushrod assembly 50 can be conventional, with the pushrods 53, 54 each including a respective lifter 51, 52 that are each configured to be driven by one of the cams 42 of the camshaft 41. The pushrods 53, 54 extend up from the lifters at a location adjacent to and beside their associated cylinder 16 to a location above the cylinder top 30 where they act on their respective rocker arms 55, 56. The rocker arms are mounted above the cylinder top 30, either on a single rocker shaft (as indicated in FIG. 2) or separately mounted for rotation, as indicated in FIG. 3. The valve stems 59, 60 are driven by the respective rocker arms 55, 56 to thereby open and close their respective valves 57, 58 within the cylinder top 30. Springs 61, 62 are mounted to provide a return force that biases the valves closed and, via the rocker arms 55, 56 and pushrods 53, 54, biases the lifters 51, 52 against their respective cams 42. As will be appreciated by those skilled in the art, the pushrod assembly 50 may include other components, or may be implemented in other ways.

Figure 1:
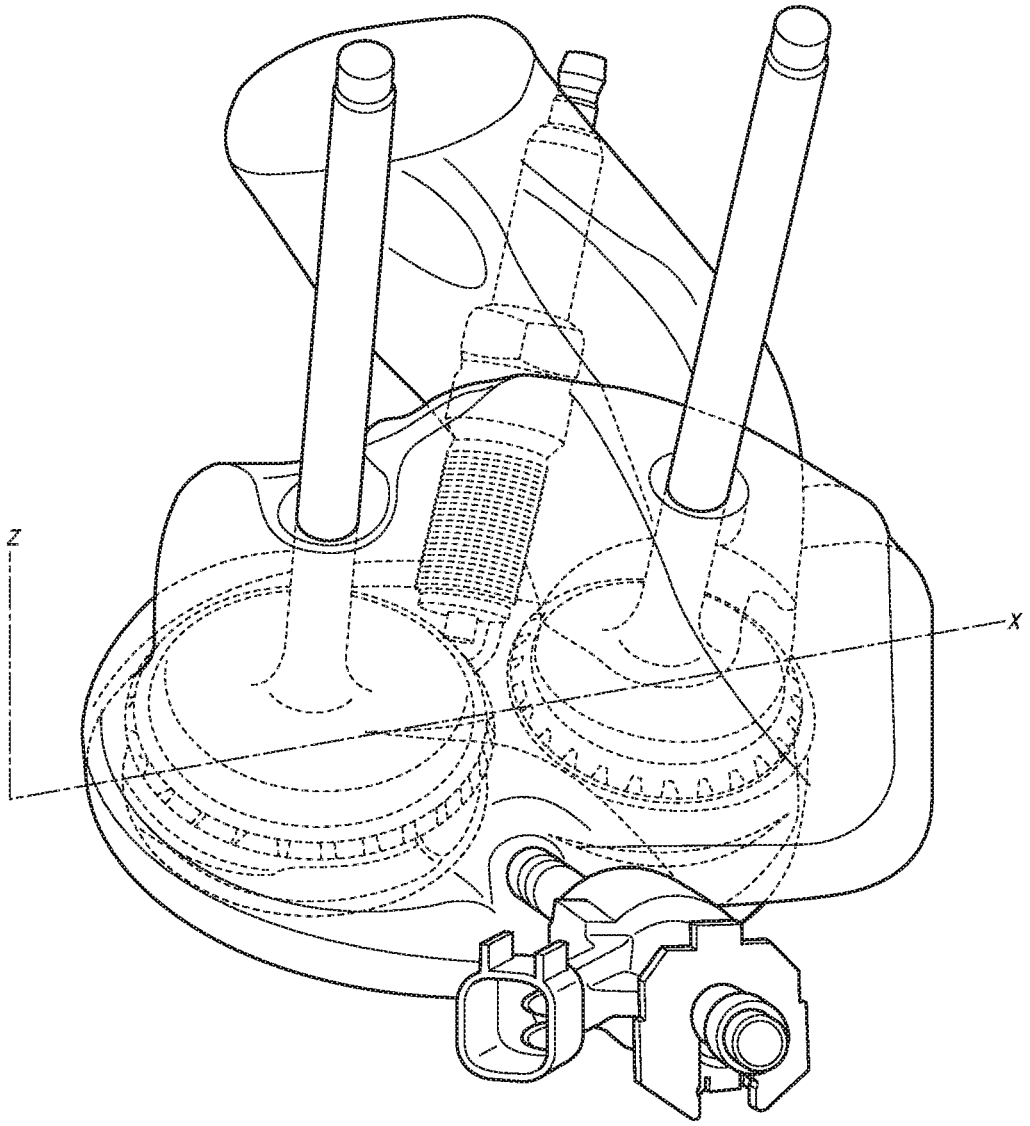
FIG. 1 PRIOR ART
FIG. 1 is a perspective view of a prior art cylinder top used in a direct fuel injection two-valve per cylinder pushrod valvetrain internal combustion engine, showing a conventional positioning of the valves, spark plug, and fuel injector.

Before describing the cylinder top 30 in detail, it may be recognized from FIGS. 2 and 3 that the cylinders 16 each have a central axis 23 that together form a vertically-oriented (x-z) common plane 24 extending the length of the engine 10. Moreover, as shown, this common plane 24 intersects the crankshaft axis 15, although in other embodiments the crankshaft axis 15 may be spaced from, but parallel to this common plane, or may be askew relative to this plane. The common plane 24 divides each cylinder into imaginary halves and it is along this x-z plane that a typical prior art two-valve per cylinder pushrod engine will have its intake and exhaust valves centered, as shown in the prior art configuration of FIG. 1. However, as indicated by FIGS. 3 and 4, in the illustrated embodiment, the valves 57, 58 are not centered on this common plane 24, but are rotated relative to this plane, thereby enabling the cylinder top 30 to include a spark plug and fuel injector to be positioned immediately adjacent each other in a near vertical orientation to one side of the plane 24.

Figure 4:
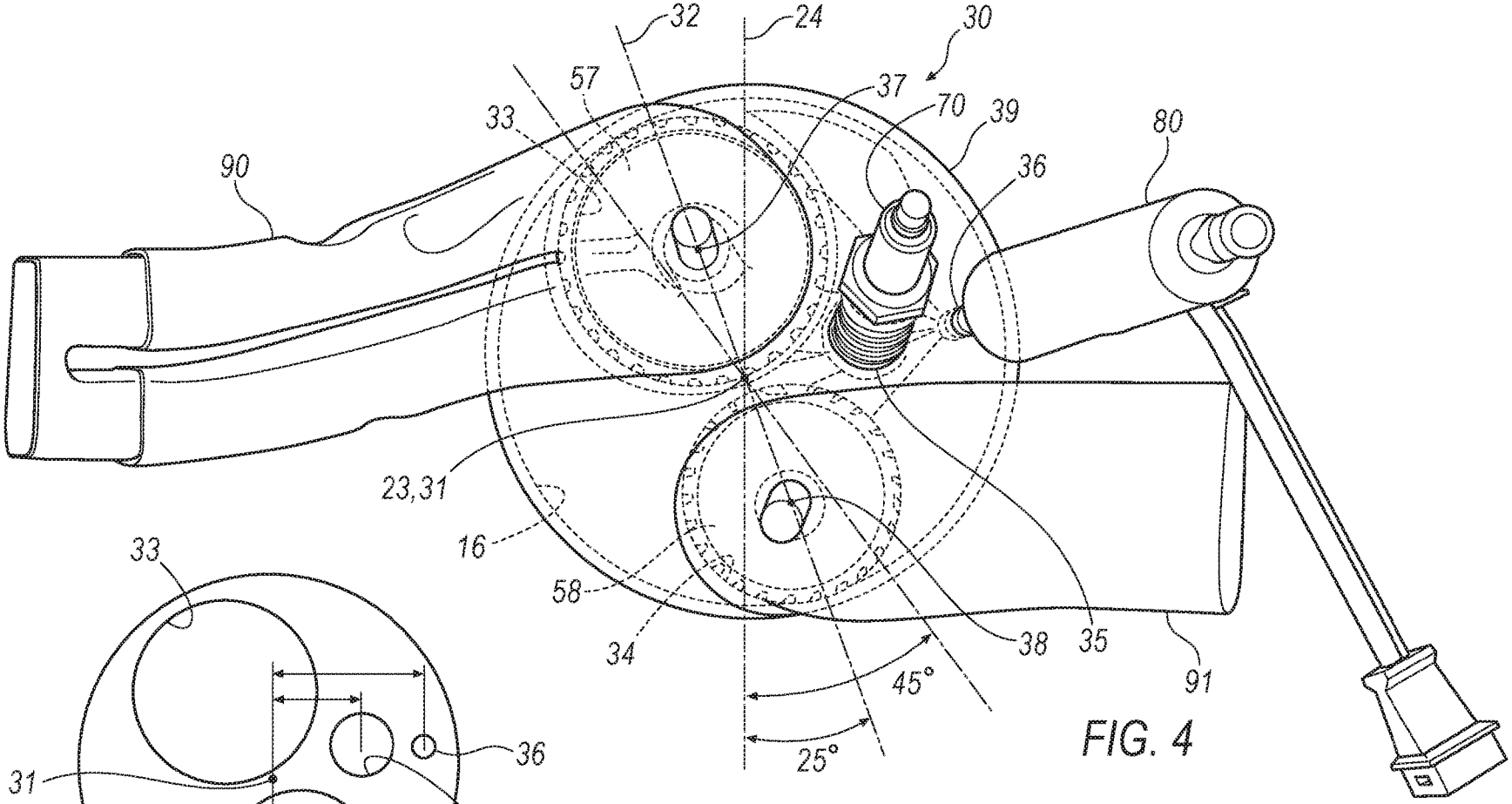
FIG. 4 is a plan view of the cylinder top and associated components shown in FIG. 3.

More specifically, with reference to FIG. 4, there is shown a top view of the cylinder top 30 showing the common plane 24 that contains the center axes 23 of the cylinders 16 and the crankshaft axis 15. As indicated therein, the valves are rotated about a center point 31 of the cylinder top 30 relative to the common plane 24. This center point 31 of the cylinder top 30 is coincident with the center axis 23 of the cylinder because the cylinder 16 and cylinder top 30 are aligned with each other. Thus, the center axis 23 of the cylinder 16 is also the center axis 31 of the cylinder top 30 which is located within the common plane 24.

As indicated in FIG. 4, there is an axis 32 centered on the two valves 57, 58. In particular, the cylinder top 30 includes two ports 33, 34, a spark plug bore 35, and a fuel injector bore 36. The ports 33 and 34 include a single intake port 33 in which the (intake) valve 57 is positioned and a single exhaust port 34 in which the (exhaust) valve 58 is positioned. Because the cylinder is limited to a single intake port (and valve) and a single exhaust port (and valve), the engine 10 is thus a two-valve engine. The ports each have a center point 37, 38, respectively, that define the intersecting axis 32. In the illustrated embodiment, this axis is at an angle of 25 degrees relative to the common plane 24. In at least some embodiments, this angle may be any angle in the range of 25 to 45 degrees, inclusive, relative to the common plane 24 that intersects the central axes 23 of the cylinders 16 and that contains or extends parallel to the crankshaft axis 15.

In the illustrated embodiment, the intersecting axis 32 that is defined by the valve center points 37, 38 also intersects the central axis 23 and center point 31 of the cylinder top 30. In other embodiments, the valves may be both rotated through some angle relative to the common plane and shifted laterally relative to the central axis 23/center point 31.

Figure 5:
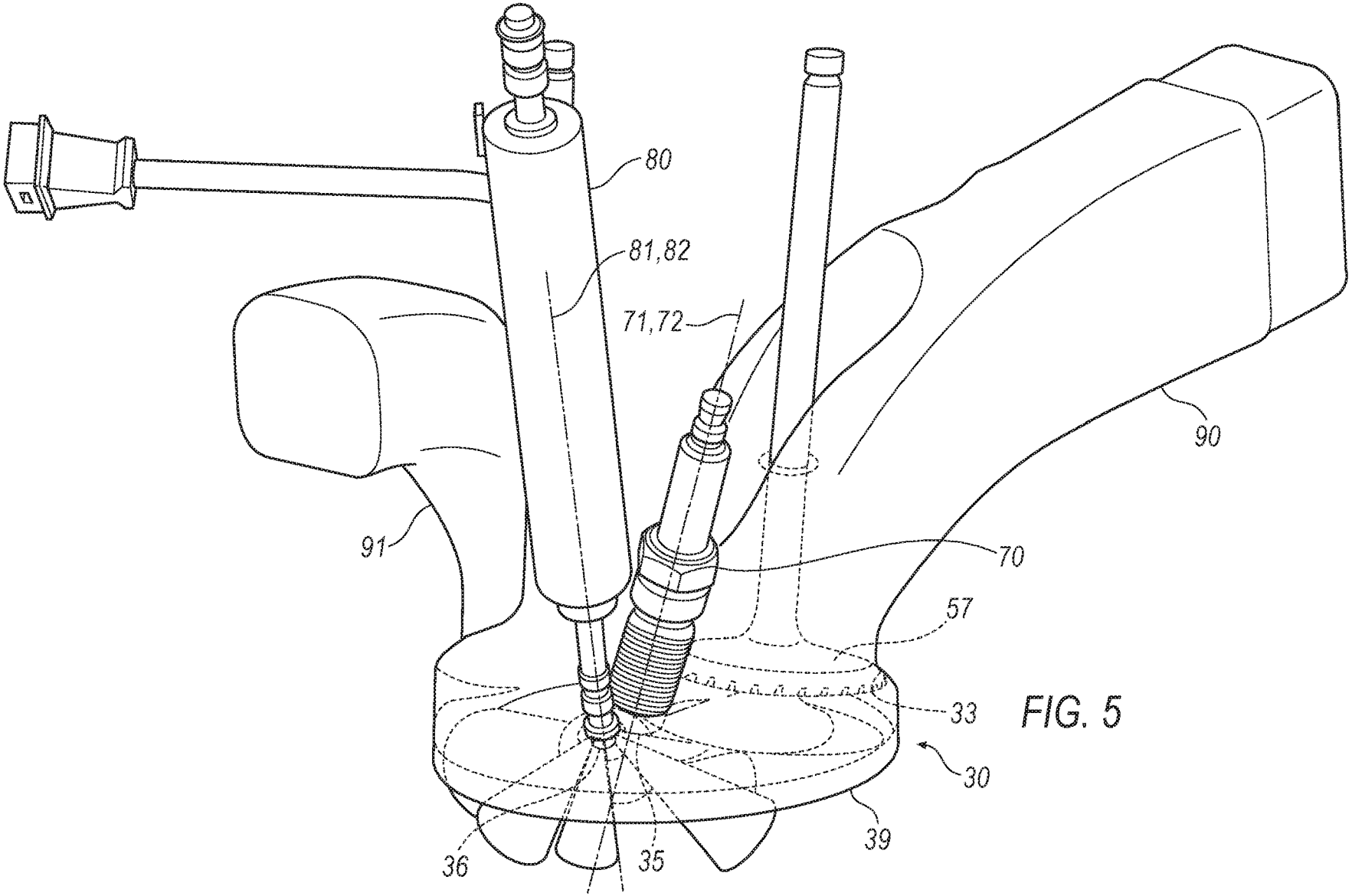
FIG. 5 is a perspective view of the cylinder top of FIG. 4.

Apart from the rotation of the valves relative to the common plane 24, the spark plug bore 35 and fuel injector bore 36 are both angled at a near vertical orientation and are co-located on the same side of that intersecting axis 32 (when viewed as in FIG. 4 from a vantage above the cylinders 16), as well as on the same side of the common plane 24. This positioning is indicated in FIGS. 4 and 5 and may allow for improved combustion dynamics leading to improved fuel economy and combustion stability. In particular, the vertical orientation and close proximity of the spark plug to the fuel injector permits late fuel injection and increased compression ratios in the cylinders.

The cylinder head 12 includes an air intake manifold 90 and an exhaust manifold 91, parts of which are shown in FIGS. 4 and 5. The intake manifold 90 extends from the intake port 33 in a first direction away from a first side of the common plane 24 (to the left shown in FIG. 4 and to the rear, right shown in FIG. 5) and the exhaust manifold 91 extends from the exhaust port 34 in a second direction away from a second side of the common plane 24 (to the right shown in FIG. 4 and to the front, left shown in FIG. 5). Similarly, the ports extend away from respective first and second sides of the intersecting axis 32. As indicated particularly in FIGS. 3 and 4, the spark plug bore 35 and spark plug 70 and the fuel injector bore 36 and fuel injector 80 are all located on the second (exhaust) side of the intersecting axis 32 and common plane 24. The pushrods 53, 54 are located on the first side of the common plane along with the intake manifold 90 which exits from the cylinder top 30 at a location between the pushrods 53, 54.

Figure 4A:
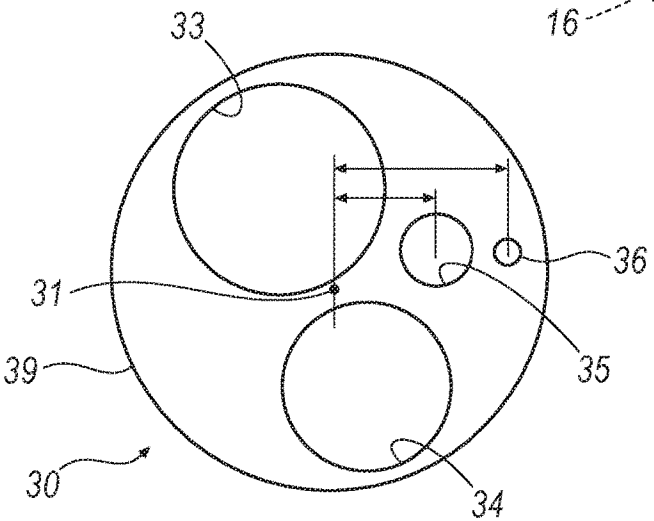
FIG. 4A is a partial view of the cylinder top of FIG. 4, showing intake and exhaust ports, and showing the relative positioning of spark plug and fuel injector bores relative to a center point of the cylinder top.

FIG. 4A depicts diagrammatically the circular outer periphery 39 of cylinder top 30, as well as the intake port 33, exhaust port 34, spark plug bore 35, and fuel injector bore 36. As shown, the spark plug bore 35 is located a first distance from the center point 31 of the cylinder top 30, whereas the fuel injector bore 36 is located a second distance from the center point 31 of the cylinder top. The first distance is less than the second distance such that the spark plug 70 is mounted closer to the center of the combustion chamber 19 that the fuel injector 80. Since the spark plug bore 35 and fuel injector bore 36 are both round, they each have a respective diameter, and in at least some embodiments, the difference between the first and second distances is greater than the sum of the radii of the bores 35 and 36. This allows the spark plug 70 and fuel injector 80 to be oriented along a common radius of the cylinder top (and combustion chamber 19) if desired for a particular application. In other embodiments, the bores 35, 36 may be located on different radii of the cylinder top 30.

FIG. 5 depicts the mounting of the spark plug 70 and fuel injector 80. As indicated, the spark plug 70 is threaded into the bore 35 and has a spark plug central axis 72 that is coincident with a central bore axis 71 of the spark plug bore 35. Similarly, the fuel injector 80 is installed into the bore 36 and has a fuel injector central axis 82 that is coincident with a central bore axis 81 of the fuel injector bore 36.

Figure 6:
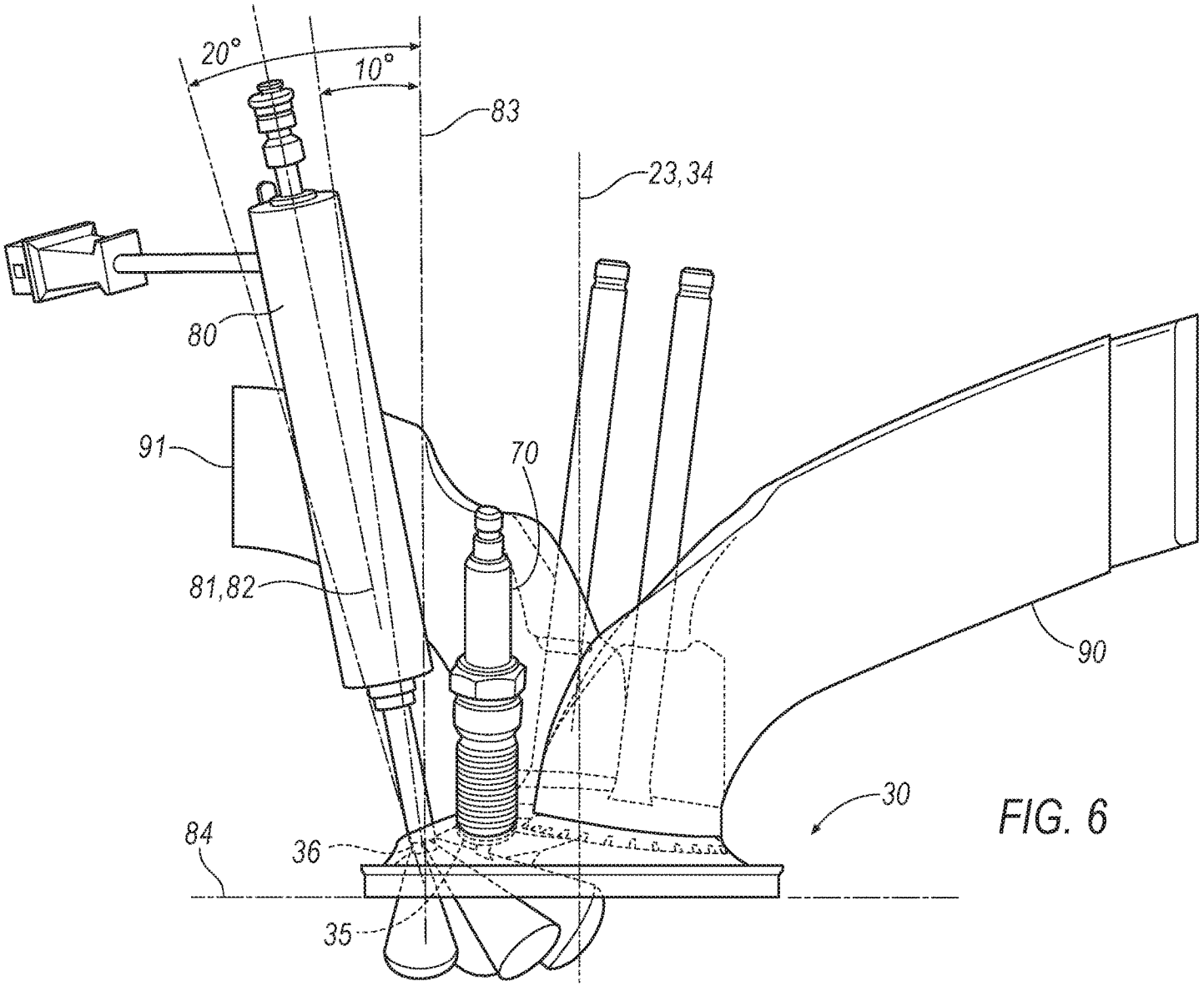
FIG. 6 is a side view of the cylinder top of FIG. 4 showing a range of angles at which the fuel injector may be oriented relative to the vertical.
Figure 7:
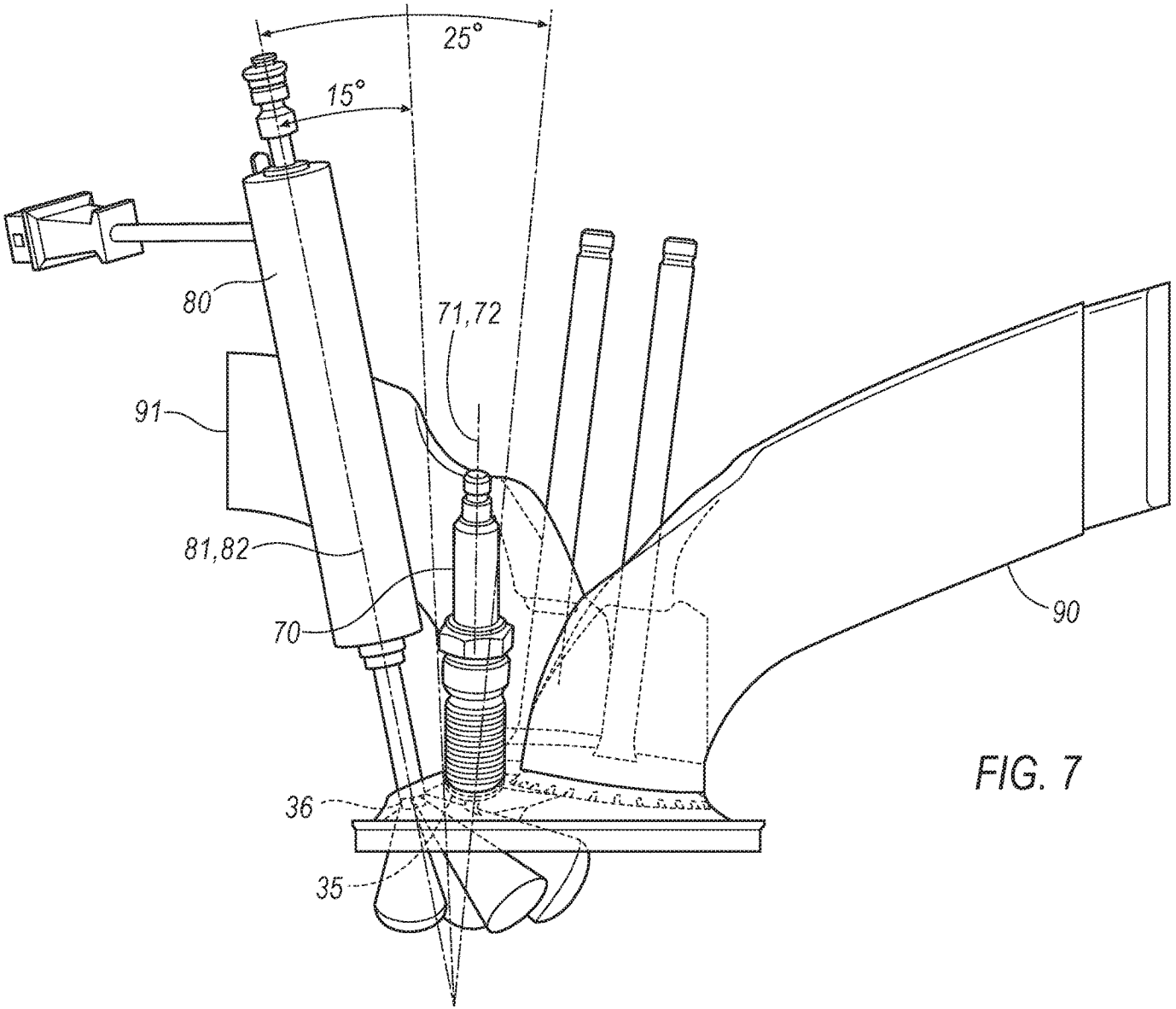
FIG. 7 is the same side view of FIG. 6 showing a range of angles at which the spark plug may be oriented relative to the fuel injector

Referring to FIGS. 6 and 7, there is shown a side view of the cylinder top 30 that demonstrates various angles of the spark plug 70 and fuel injector 80 as dictated by the angular orientations of their respective bores 35, 36. In FIG. 6, a range of possible fuel injector angles are shown relative to vertical, although in some embodiments angles outside of the displayed range may be used. The angles are taken relative to a reference axis 83 that extends perpendicularly to a horizontal plane 84 in which the circular periphery 39 of the cylinder top lies. In the illustrated embodiment, this reference axis 83 is parallel to the central axis 23/common plane 24, although it not necessarily be so. In at least some embodiments, the angle of the fuel injector bore axis 81 (and thus, fuel injector central axis 82) may be at an angle of between 10 and 20 degrees, inclusive, relative to the reference axis 83.

In FIG. 7, there is shown a range of angles of the spark plug 70 relative to the fuel injector 80; that is, a range of angles for the spark plug bore axis 71 (and thus, spark plug central axis 72) relative to the fuel injector bore axis 81 (and thus, fuel injector central axis 82). In at least some embodiments, the angle may be between 15 and 25 degrees, inclusive.

The ranges of angles shown in the drawings are useful in a number of different embodiments, but larger or smaller angles may be used depending on the particular application of the pushrod valvetrain combustion system.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation. In addition, the term "and/or" is to be construed as an inclusive OR. Therefore, for example, the phrase "A, B, and/or C" is to be interpreted as covering all of the following: "A"; "B"; "C"; "A and B"; "A and C"; "B and C"; and "A, B, and C."

The invention claimed is:

1. A pushrod valvetrain combustion system assembly for an internal combustion engine, comprising:

a cylinder top that forms a portion of a cylinder head, the cylinder top configured to close the top of an engine cylinder in an engine block to thereby at least partially define a combustion chamber between the cylinder top and engine cylinder, the cylinder top including a single intake port such that the cylinder top has only one intake opening, a single exhaust port such that the cylinder top has only one exhaust opening, a spark plug bore, and a fuel injector bore, a two-valve pushrod assembly including:

first and second pushrods each having a first end and a second end, the second end opposite the first end, the first and second pushrods each having a lifter positioned at the first end thereof, the lifters configured to be driven by cams on a camshaft of the internal combustion engine;

first and second rocker arms that are mounted above the cylinder top and that are driven by and in contact with the second ends of the first and second pushrods, respectively;

an intake valve positioned in the intake port and having a valve stem driven by the first rocker arm; and an exhaust valve positioned in the exhaust port and having a valve stem driven by the second rocker arm;

wherein the intake port and exhaust port are positioned adjacent each other and are positioned along an axis that intersects a center point of each of the ports; and wherein the spark plug bore and fuel injector bore are both located in the cylinder top on a same side of the axis intersecting the center points of the intake and exhaust ports.

2. The pushrod valvetrain combustion system assembly defined in claim 1, wherein the cylinder top has a circular periphery lying within a plane oriented perpendicular to a reference axis, and the fuel injector bore has a central bore axis extending through a center of the fuel injector bore where the fuel injector bore meets the combustion chamber, the central bore axis oriented at an angle of between 10 and 20 degrees, inclusive, relative to the reference axis.

3. The pushrod valvetrain combustion system assembly defined in claim 2, wherein the spark plug bore has a central bore axis that is at an angle of between 15 and 25 degrees, inclusive, relative to the central bore axis of the fuel injector bore.

4. The pushrod valvetrain combustion system assembly defined in claim 1, wherein the fuel injector bore has a central bore axis and the spark plug bore has a central bore axis that is at an angle of between 15 and 25 degrees, inclusive, relative to the central bore axis of the fuel injector bore.

5. The pushrod valvetrain combustion system assembly defined in claim 1, wherein the spark plug bore and fuel injector bore are located first and second distances, respectively, from a center point of the cylinder top, and wherein the first distance is less than the second distance.

6. The pushrod valvetrain combustion system assembly defined in claim 5, wherein the spark plug bore and fuel injector bore each have a radius and wherein the difference between the first and second distances is greater than the sum of the radii of the spark plug and fuel injector bores.

7. The pushrod valvetrain combustion system assembly defined in claim 1, wherein the pushrod valvetrain combustion system assembly includes a plurality of the cylinder tops and a corresponding plurality of the pushrod assemblies, wherein the plurality of cylinder tops and pushrod assemblies are associated with a corresponding plurality of engine cylinders in the engine block, and wherein:

each of the cylinder tops has a circular periphery oriented perpendicular to a common plane that extends through each cylinder top and that includes a central axis of each of the engine cylinders when the cylinder head is mounted to the engine block; and the axis intersecting the center points of the intake and exhaust ports of each cylinder top is at a non-zero angle relative to the common plane.

8. The pushrod valvetrain combustion system assembly defined in claim 7, wherein the non-zero angle is between 25 and 45 degrees, inclusive.

9. The pushrod valvetrain combustion system assembly defined in claim 7, further comprising an intake manifold and an exhaust manifold, wherein the intake manifold extends from the intake ports of the cylinder tops in a first direction away from a first side of the common plane and the exhaust manifold extends from the exhaust ports of the cylinder tops in a second direction away from a second side of the common plane, and wherein the fuel injector bore is located on the second side of the common plane.

10. The pushrod valvetrain combustion system assembly defined in claim 9, wherein the pushrods are located on the first side of the common plane and the spark plug bore is located on the second side of the common plane.

11. A direct fuel injection, two-valve pushrod valvetrain internal combustion engine, comprising:

an engine block having a plurality of engine cylinders;

a cylinder head mounted on the engine block and comprising a plurality of cylinder tops each aligned with a different one of the engine cylinders, each engine cylinder and associated cylinder top together at least partially defining a combustion chamber of the internal combustion engine, wherein each of the cylinder tops includes a single intake port such that the cylinder tops each have only one intake opening, a single exhaust port such that the cylinder top has only one exhaust opening, a spark plug bore, and a fuel injector bore;

a plurality of spark plugs, each having a spark plug central axis and being mounted within a different one of the spark plug bores so as to provide spark energy within its associated combustion chamber when in use;

a plurality of fuel injectors, each having a fuel injector central axis and being mounted within a different one of the fuel injector bores so as to provide a spray of fuel within its associated combustion chamber when in use;

a crankshaft mounted within the engine block and having a crankshaft axis about which the crankshaft rotates;

a plurality of pistons, each positioned in a different one of the engine cylinders and connected to the crankshaft by a piston rod;

a pushrod valvetrain system that includes a camshaft and a plurality of two-valve pushrod assemblies, each of the pushrod assemblies being positioned at least partially within the cylinder head adjacent a different one of the combustion chambers, wherein the camshaft is mounted beside the engine cylinders and wherein each of the two-valve pushrod assemblies comprise:

first and second pushrods each having a lifter configured to be driven by cams on the camshaft;

first and second rocker arms that are mounted above the cylinder top and that are driven by the first and second pushrods, respectively;

an intake valve positioned in the intake port and having a valve stem driven by the first rocker arm; and an exhaust valve positioned in the exhaust port and having a valve stem driven by the second rocker arm;

wherein the intake port and exhaust port of each cylinder top are positioned adjacent each other and are positioned along an axis that intersects a center point of each of the ports; and wherein the spark plug bore and fuel injector bore of each cylinder top are both located in the cylinder top on a same side of the axis intersecting the center points of the intake and exhaust ports.

12. The direct fuel injection, two-valve pushrod valvetrain internal combustion engine defined in claim 11, wherein each cylinder top has a circular periphery lying within a plane oriented perpendicular to a reference axis, wherein the fuel injector central axis extends through a center of the fuel injector bore where the fuel injector bore meets the combustion chamber, and wherein the fuel injector central axis is at an angle of between 10 and 20 degrees, inclusive, relative to the reference axis.

13. The direct fuel injection, two-valve pushrod valvetrain internal combustion engine defined in claim 12, wherein the spark plug central axis is at an angle of between 15 and 25 degrees, inclusive, relative to the fuel injector central axis.

14. The direct fuel injection, two-valve pushrod valvetrain internal combustion engine defined in claim 11, wherein the spark plug central axis is at an angle of between 15 and 25 degrees, inclusive, relative to the fuel injector central axis.

15. The direct fuel injection, two-valve pushrod valvetrain internal combustion engine defined in claim 11, wherein the spark plug bore and fuel injector bore are located first and second distances, respectively, from a center point of the cylinder top, and wherein the first distance is less than the second distance.

16. The direct fuel injection, two-valve pushrod valvetrain internal combustion engine defined in claim 15, wherein the spark plug bore and fuel injector bore each have a radius and wherein the difference between the first and second distances is greater than the sum of the radii of the spark plug and fuel injector bores.

17. The direct fuel injection, two-valve pushrod valvetrain internal combustion engine defined in claim 11, wherein:

each of the engine cylinders has a central axis, with all of the central axes of the engine cylinders lying within a common plane;

the crankshaft axis is parallel to, or lies within, the common plane; and the axis intersecting the center points of the intake and exhaust ports of each cylinder top is at a non-zero angle relative to the common plane.

18. The direct fuel injection, two-valve pushrod valvetrain internal combustion engine defined in claim 17, wherein the non-zero angle is between 25 and 45 degrees, inclusive.

19. The direct fuel injection, two-valve pushrod valvetrain internal combustion engine defined in claim 17, further comprising an intake manifold and an exhaust manifold, wherein the intake manifold extends from the intake ports of the cylinder tops in a first direction away from a first side of the common plane and the exhaust manifold extends from the exhaust ports of the cylinder tops in a second direction away from a second side of the common plane, and wherein the fuel injector is located on the second side of the common plane.

20. The direct fuel injection, two-valve pushrod valvetrain internal combustion engine defined in claim 19, wherein the pushrods are located on the first side of the common plane and the spark plug is located on the second side of the common plane.

* * * * *